United States Patent [19]

Pitts

[11] 3,955,664

[45] May 11, 1976

[54] APPARATUS FOR THE TRANSFER AND ALIGNMENT OF BOBBINS

[75] Inventor: Thomas E. Pitts, Cranston, R.I.

[73] Assignee: Leesona Corporation, Warwick, R.I.

[22] Filed: Apr. 21, 1975

[21] Appl. No.: 570,262

Related U.S. Application Data

[63] Continuation of Ser. No. 424,160, Dec. 12, 1973, abandoned.

[52] U.S. Cl. ..... 198/24; 198/26; 221/13

[51] Int. Cl.[2] ..... B65G 47/00

[58] Field of Search ..... 198/248, 251, 272, 278, 198/281, 282, 283, 287, 24, 26, 20 R; 221/171, 172, 173, 13, 268

[56] References Cited

UNITED STATES PATENTS

| | | | |
|---|---|---|---|
| 2,790,535 | 4/1957 | Ashby | 198/282 |
| 3,339,702 | 9/1967 | Novak | 198/248 X |
| 3,367,534 | 2/1968 | Carter | 221/172 X |
| 3,392,815 | 7/1968 | Skeels et al. | 221/172 X |
| 3,474,890 | 10/1969 | Center | 198/248 X |
| 3,631,955 | 1/1972 | Chaplinski | 221/173 X |

*Primary Examiner*—John J. Love
*Assistant Examiner*—James L. Rowland
*Attorney, Agent, or Firm*—Burnett W. Norton

[57] ABSTRACT

The instant invention relates to a mechanism for aligning bobbins in, for example, a loom for subsequent movement of the bobbins to, for example, a stripping unit associated with the loom. The apparatus includes an inclined ramp upon which the bobbins fall and an upstream deflector mechanism to deflect and position a falling bobbin for engagement with the inclined ramp to align the bobbins and to prevent jamming thereof.

5 Claims, 5 Drawing Figures

APPARATUS FOR THE TRANSFER AND ALIGNMENT OF BOBBINS

This is continuation, continuation of application Ser. No. 424,160 filed Dec. 12, 1973 now abandoned.

BACKGROUND OF THE INVENTION

Various stripping mechanisms are well known in the art whereby bobbins are urged in position for stripping in vertical and adjacent relationship. Frequently bobbins are fed to such a mechanism after falling to a conveyor from, for example, shuttles in a loom. During the fall of the bobbins to the conveyor a prevalent problem which has existed is that the bobbins frequently tend to become jammed, i.e., a falling bobbin may become wedged between bobbins already upon the conveyor, or between a frame member and another bobbin which has previously fallen to the conveyor. It is therefore highly desirable that an apparatus and method be provided which conveniently overcomes this jamming tendency in order to properly and continuously supply bobbins to, for example, a stripping unit in proper orientation.

SUMMARY OF THE INVENTION

The instant invention relates to an apparatus to prevent jamming of bobbins on a conveying mechanism which includes an inclined ramp and, upstream from the inclined ramp, a diverter member positioned and configured to cooperate with the ramp to prevent jamming of the bobbins as they are dropped to a conveying mechanism. The instant invention also relates to a method of aligning and of preventing the jamming of bobbins when falling to a mechanism for conveying of the bobbins to, for example, a stripping mechanism.

OBJECTS OF THE INVENTION

It is a principle object of the present invention to provide an apparatus to prevent the jamming of bobbins when dropped to a conveying mechanism for conveying thereof to downstream apparatus.

It is a further object of the present invention to provide an apparatus as aforesaid which is convenient and expeditious to use.

DESCRIPTION OF THE PREFERRED EMBODIMENT

Figure 1:
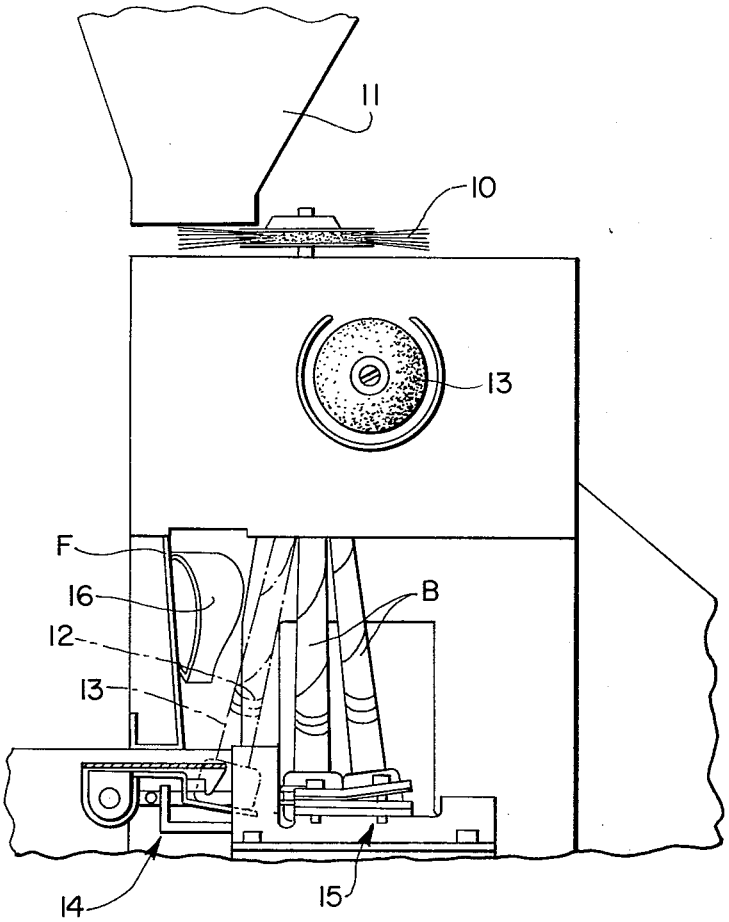
FIG. 1 is a side elevational view of a bobbin handling apparatus illustrative of the present invention.

Referring firstly to FIG. 1 a rotatable brush 10 is shown positioned beneath a guide chute 11 to engage the end of strands 12 upon bobbins B and unwind yarn remaining thereon. The brush 10 is suitably connected to means (not shown) to rotate the brush. A stripper cone 13 is suitably positioned and connected to means (also not shown) to rotate the cone in such a manner as to intercept the strands 12 when they have been engaged by the brush 10 and after the bobbins have fallen butt end first to the alignment mechanism of the present invention, generally illustrated and referred to by arrow 14. From the alignment mechanism 14, the bobbin proceeds to guides for stripping of strand remaining upon the bobbin, shown by the arrow 15, in a manner later shown. Positioned above the alignment mechanism 14, and suitably connected to the frame F, a collar 16 is provided to cooperate with the alignment plate to align the bobbins, in a fashion which will also later become clear.

Figure 2:
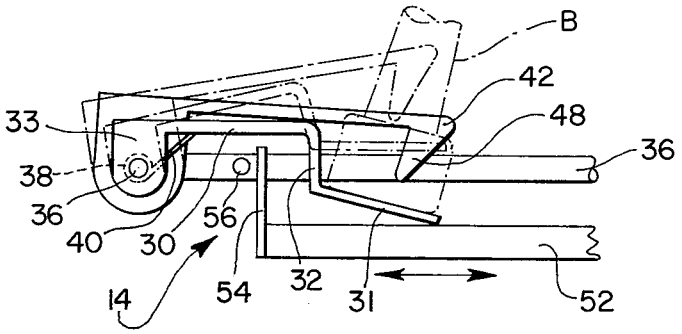
FIG. 2 is a detailed side elevational view thereof.
Figure 3:
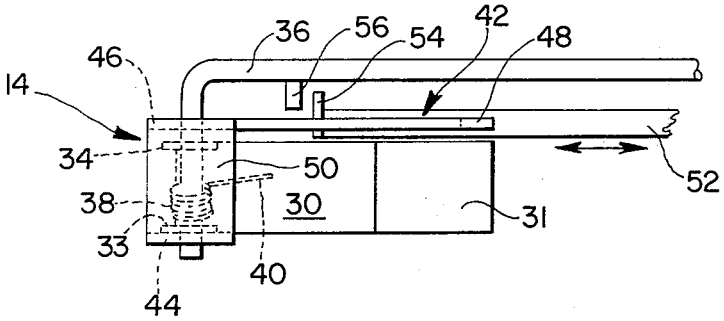
FIG. 3 is a detailed top plan view thereof.

Referring now to FIGS. 2 and 3 the detailed structure of the alignment mechanism 14 will now be discussed.

As is seen an alignment plate 30 includes a bobbin receiving portion 31 and a bobbin abutment portion 32 to cooperate in holding the bobbin and further includes a pair of downwardly extending tabs 33 and 34 which are pivotally journalled about a shaft 36. A spring 38 is positioned about the shaft 36 and includes an outwardly extending end portion 40 which abuts against the underside of the alignment plate 30 to urge the plate to an upward position for engagement by a dropped bobbin B. The weight of the dropped bobbin B then overrides the tension of the spring 38 and thereby depresses the alignment plate 30, as shown in FIG. 2. A member 42 is also provided and includes downwardly extending tabs 44 and 46 which are freely pivotally mounted about the shaft 36. The member 42 further includes a downwardly extending hook portion 48, the purpose of which will later become clear, and a stop member or platform 50 which rests upon the bobbin alignment plate 30, so that, as the alignment plate 30 is pivoted upward by means of the spring 38, and downward under the weight of a bobbin, the member 42 correspondingly pivots. A rod 52, which carries a lug 54 on the end thereof, is connected to a mechanism which continuously reciprocates the rod and is positioned so that as the rod is reciprocated the lug 54 engages the hook portion 48 of the member 42 to move the assembly downstream when the member 42 pivots downward, as the plate 30 pivots downward under the weight of a bobbin. It should be noted that the member 42 is free to be upwardly displaced by camming engagement of the lug 54 with its hook portion 48 as the rod 52 moves to the left as shown in the drawings and is free to drop once the lug passes by so as to be in position to engage each lug on the return stroke (to the right as shown in the drawings) of the rod 52. An additional lug 56 is suitably secured to the rod 36 and in the return path (return from previous stroke which stroke was a return of the initially described stroke to the left as shown in the drawings) of the lug 54 so that as the rod 52 is returned these lugs engage to return the entire assembly. Thus, in this fashion, the entire assembly is reciprocated to carry a bobbin resting upon the plate 30 towards engagement with the downstream apparatus, as shown in FIG. 1. Since the plate 30 is pivoted downward, the dropped bobbin is tilted towards the downstream apparatus 15 whereat it is securedly engaged and then slides from the plate 30 to an upright position when the alignment mechanism 14 is returned. Since the bobbin is tilted towards the downstream direction should an additional bobbin be dropped before the first bobbin has left the plate 30 the additional bobbin will fall to position upstream of the bobbin upon the plate 30, thereby preventing jamming of the bobbins.

Figure 4:
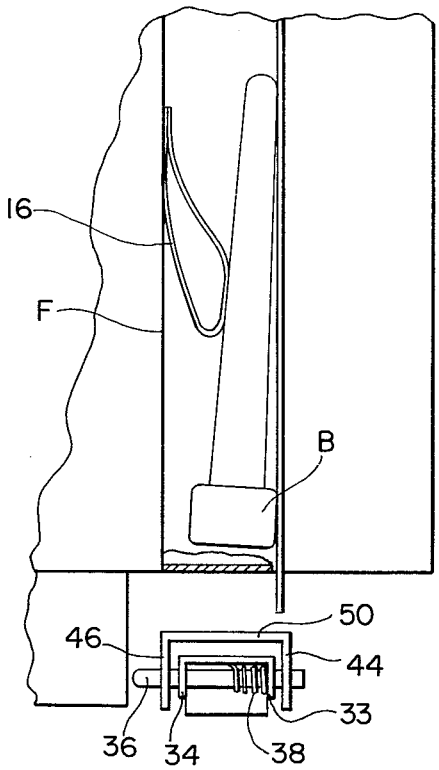
FIG. 4 is a side elevational view of an alignment guide comprising part of the alignment mechanism of the present invention.
Figure 5:
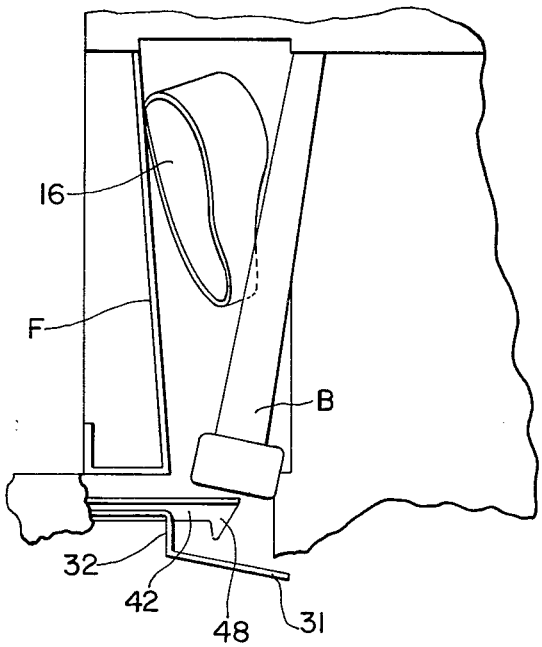
FIG. 5 is a front elevational view of the guide shown in FIG. 4.

To assist in the proper alignment of the incoming bobbins the aforementioned collar 16 is preferably provided and is positioned in the path of fall of the bobbins. The collar 16 is of any suitably resilient material, such as Mylar and is conveniently formed from a single strip thereof with the opposing ends fastened to the frame F to form a loop extending into the path of fall of the bobbins, as more clearly shown in FIGS. 4 and 5. As is also shown in FIGS. 4 and 5 the collar 16 is further positioned so as to urge a falling bobbin forward, i.e., towards the front of the entire assembly and associated apparatus as depicted in the front elevational view of FIG. 1, and to initiate tilting of the bobbin towards the downstream direction in cooperation with the alignment mechanism 14. Should the alignment plate 30 already be in a downward position under the weight of a previously fallen bobbin then the bobbin, upon passing by the collar 16 due to its aforementioned resiliently, comes to rest between the downstream bobbin and the collar from whence its falls to the bobbin rest portion 31 of the plate 30 following advancement and return of the alignment mechanism 14.

In operation therefore a bobbin B falls through the chute 11 past the brush 10 for interception of a strand and thence resiliently past the collar 16 to initially align the bobbin. The bobbin then falls to the bobbin rest portion 31 of the alignment plate 30 and depresses the plate 30. As the plate 30 is depressed the member 42 and thereby the hook portion 48 is allowed to drop. Reciprocation of the rod 52 then causes engagement of the hook portion by the lug 54 to move the mechanism 14 towards the downstream apparatus. At its forward or downward stroke the bobbin B is engaged and held by the apparatus 15, whereat stripping commences by engagement of the strand about the stripper cone 13. The rod 52 then returns thereby causing the lug 54 to engage the lug 56 carried on the rod 36 to return the alignment mechanism 14 for another cycle. As the mechanism 14 is returned, and thereby the alignment plate 30, the bobbin is caused to slide from the alignment plate. Should a bobbin already be present upon the rest portion 31 of the alignment plate 30 then the bobbin falls to a position between the downstream bobbin and the frame F until the downstream bobbin has been engaged by the downstream apparatus, and the mechanism 14, and thereby the alignment plate 30, returned. Upon return the bobbin then falls to the rest portion 31 of the plate to in turn be urged to the downstream mechanism. At this point the downstream bobbin is displaced by engagement by the incoming bobbin since the incoming bobbin is securely held for forward movement by the bobbin abutment portion 32 of the alignment plate 30.

It should be apparent that the present invention may be embodied in other specific forms without departing from the spirit or essential attributes threof, all of which are intended to be encompassed by the appended claims.

What is claimed is:

1. Apparatus for the transfer of bobbins along a common path from a first position to a second downstream position removed therefrom comprising, a plate having a bobbin receiving portion pivotable about an upstream axis from an initial bobbin engaging position to a subsequent depressed position inclined with respect to the downstream direction for tilting a bobbin towards said downstream direction and a follower member supported by said plate and adapted to pivot therewith, said member having a hook portion offset from said plate, and a continuously reciprocating means to move said plate and said follower member back and forth along said path, said reciprocating means engageable with said hook portion to move said plate and said follower member in the downstream direction when said plate is in said depressed position and engageable with said plate to return said plate and follower member to their upstream position.

2. The apparatus of claim 1 wherein said plate includes a step to define upper and lower portions thereof, comprises a plate having a step to define upper and lower portions thereof, said lower portion being adapted to receive and tilt said bobbins, a shaft journaled through said plate to provide pivotal movement thereof, a spring positioned about said shaft and operatively connected with said plate to permit pivotal movement of said plate when engaged by said bobbins to an inclined position in the direction of travel of said bobbins, said follower member rotatably journaled about said shaft and having a platform portion supported by the upper portion of said plate.

3. Apparatus in accordance with claim 1 including a lug connected with said shaft and in the path of travel of said plate for engagement thereof to move said plate and said follower in said upstream direction.

4. The apparatus of claim 1 including assisting means upstream from said plate to engage and tilt said bobbins in said downstream position prior to said bobbins engaging said plate.

5. The apparatus of claim 4 wherein said assisting means comprises a looped strip of reslient material extending into the upstream path of bobbins generally above and normal to the initial bobbin engaging position of said plate.

* * * * *